US009957069B2

(12) United States Patent
Ishikawa et al.

(10) Patent No.: US 9,957,069 B2
(45) Date of Patent: May 1, 2018

(54) PACKAGING MACHINE AND PACKAGING METHOD

(75) Inventors: Shinji Ishikawa, Aichi (JP); Shinya Ozeki, Aichi (JP)

(73) Assignee: GENERAL PACKER CO., LTD., Aichi (JP)

( * ) Notice: Subject to any disclaimer, the term of this patent is extended or adjusted under 35 U.S.C. 154(b) by 895 days.

(21) Appl. No.: 14/003,877

(22) PCT Filed: Mar. 27, 2012

(86) PCT No.: PCT/JP2012/057855

§ 371 (c)(1),
(2), (4) Date: Sep. 9, 2013

(87) PCT Pub. No.: WO2013/145113

PCT Pub. Date: Oct. 3, 2013

(65) Prior Publication Data

US 2014/0033649 A1 Feb. 6, 2014

(51) Int. Cl.
*B65B 1/04* (2006.01)
*B65B 39/12* (2006.01)
(Continued)

(52) U.S. Cl.
CPC ..... *B65B 1/04* (2013.01); *B65B 1/06* (2013.01); *B65B 7/02* (2013.01); *B65B 31/00* (2013.01);
(Continued)

(58) Field of Classification Search
CPC .. B65B 1/04; B65B 1/06; B65B 31/00; B65B 31/048; B65B 39/12; B65B 39/145; B65B 7/02
(Continued)

(56) References Cited

U.S. PATENT DOCUMENTS 3,182,432 A * 5/1965 Canfield ..... B65B 31/06 53/374.8
4,027,456 A * 6/1977 Wilson ..... B65B 31/024 53/110
(Continued)

FOREIGN PATENT DOCUMENTS

EP 1378450 A1 1/2004
EP 2103520 A1 9/2009
(Continued)

OTHER PUBLICATIONS

Office Action for Japanese Patent App. No. 2014-507083 dated Nov. 16, 2015.
(Continued)

*Primary Examiner* — Hemant M Desai
*Assistant Examiner* — Mary Hibbert
(74) *Attorney, Agent, or Firm* — Cermak Nakajima & McGowan LLP; Tomoko Nakajima

(57) ABSTRACT

Providing a packaging machine and a packaging method both of which are capable of packaging with an imperforate bag provided with no small apertures or no aerating part, can prevent contamination of foreign substances such as insects and can further prevent the packaging bags from being damaged or collapsed during storage in a piled state or transportation by execution of reliable deaeration. The packaging machine and a packaging method have a closing unit 4 which holds a vicinity of mouth a of a packaging bag A inserted with a deaeration nozzle held from opposed sides of the bag A, an airway securing unit, a shaping press unit and a temporary sealing unit.

11 Claims, 16 Drawing Sheets

(51) Int. Cl.

| | |
|---|---|
| ***B65B 7/02*** | (2006.01) |
| ***B65B 31/00*** | (2006.01) |
| ***B65B 31/04*** | (2006.01) |
| ***B65B 39/14*** | (2006.01) |
| ***B65B 51/14*** | (2006.01) |
| ***B65B 1/06*** | (2006.01) |

(52) U.S. Cl.
CPC ..... *B65B 31/048* (2013.01); *B65B 39/12* (2013.01); *B65B 39/145* (2013.01); *B65B 51/146* (2013.01)

(58) Field of Classification Search
USPC ..... 53/434
See application file for complete search history.

(56) References Cited

U.S. PATENT DOCUMENTS

| | | | | |
|---|---|---|---|---|
| 2005/0276521 | A1* | 12/2005 | Price | B31B 19/00 383/10 |
| 2009/0223172 | A1* | 9/2009 | Hirano | B65B 31/042 53/403 |

FOREIGN PATENT DOCUMENTS

| | | | |
|---|---|---|---|
| JP | 62-99503 | U | 6/1987 |
| JP | 08-034412 | A | 2/1996 |
| JP | 10-114307 | A | 5/1998 |
| JP | 10-181713 | A | 7/1998 |
| JP | 10-230913 | A | 9/1998 |
| JP | 2010-126244 | A | 6/2010 |

OTHER PUBLICATIONS

Communication Pursuant to Article 94(3) EPC for EP Patent App. No. 12872823.5 dated May 20, 2016.
International Search Report and Written Opinion for PCT Patent App. No. PCT/JP2012/057855 dated May 1, 2012.
Supplementary European Search Report for European Patent App. No. 12872823.5 dated Sep. 25, 2015.
Search Report on the State of the Art for Polish App. No. P409490 dated Aug. 7, 2015.
Office Action from Canadian Patent App. No. 2,828,282 (dated Dec. 27, 2017).

* cited by examiner

PACKAGING MACHINE AND PACKAGING METHOD

This application is a national phase entry under 35 U.S.C. § 371 of PCT Patent Application No. PCT/JP2012/057855, filed on Mar. 27, 2012, which is incorporated by reference.

TECHNICAL FIELD

The present invention relates to a packaging machine for and a packaging method of filling a packaging bag with an article such as rice, sugar, salt or pet food and sealing the packaging bag.

BACKGROUND ART

There have conventionally been provided packaging machines which support a packaging bag in a suspending manner with an upper open end thereof up, fill the packaging bag with rice, sugar, salt, pet food or the like and apply heat seal to an upper open end of the bag, thereby packaging a powder or granular article.

However, when the packaging bag is sealed with air remaining in the bag, compressed remaining air sometimes damages or collapses the packaging bag during storage of packaging bags in a piled state or transportation of packaging bags.

Accordingly, a process has been employed in which a packaging bag filled with an article and sealed is shaped on a shaping conveyor attached to the packaging machine, into a substantially predetermined thickness and a small aperture is formed in the bag using a needle so that remaining air is eliminated. Another process has been employed in which the packaging bag is heat-sealed in a pattern of labyrinth so that the bag has an air permeability or a vent filter is provided together with the heat seal in the labyrinth pattern so that remaining air is eliminated.

However, when the packaging bag has the small aperture or a vent portion, foreign matter such as insects is entrapped into the packaging bag. In view of this, the applicant previously proposed a packaging method which is capable of packaging with an imperforate bag provided with no small apertures or no aerating part, preventing contamination of foreign substances such as insects and further preventing the packaging bags from being damaged or collapsed during storage in a piled state or transportation (JP-A-2010-126244).

PRIOR ART DOCUMENT

Patent Documents

Patent Document 1: Japanese Patent Application Publication No. JP-A-2010-126244

SUMMARY OF THE INVENTION

Problem to be Overcome by the Invention

The inventor of the present application proposes a packaging machine and a packaging method both of which can reliably deaerated a packaging bag filled with an article by further improving the above-described packaging method. That is, a problem of the present invention is to provide a packaging machine and a packaging method both of which are capable of packaging with an imperforate bag provided with no small apertures or no aerating part, can prevent contamination of foreign substances such as insects and can further prevent the packaging bags from being damaged or collapsed during storage in a piled state or transportation by execution of reliable deaeration.

Means for Overcoming the Problem

What solves the above-described problem is a packaging machine which fills with an article to be packaged a packaging bag supported in a suspended manner by a pair of grips with a mouth thereof on the top, eliminates air in the packaging bag by a deaeration nozzle and heat-seals the mouth, the machine comprising a closing unit which holds a vicinity of the mouth of the packaging bag into which the deaeration nozzle is inserted, from opposite sides of the packaging bag, thereby closing the packaging bag.

What further solves the above-described problem is a packaging method of a packaging machine, comprising a filling step of filling with an article to be packaged a packaging bag supported in a suspended manner by a pair of grips with a mouth thereof on the top, a deaeration step of eliminating air in the packaging bag by a deaeration nozzle and a sealing step of heat-sealing the mouth, wherein the deaeration step is executed in a condition where a vicinity of the mouth of the packaging bag into which the deaeration nozzle is inserted is held from front and back of the packaging bag thereby to be closed.

Effect of the Invention

The packaging machine and the packaging method of the present invention are capable of packaging by the use of an imperforate bag provided with no small apertures or no aerating part, can prevent contamination of foreign substances such as insects and can further prevent the packaging bags from being damaged or collapsed during storage in a piled state or transportation by execution of reliable deaeration.

MODE FOR CARRYING OUT THE INVENTION

A packaging machine and a packaging method are realized both of which can prevent the packaging bag from being damaged or collapsed during storage in a piled state or transportation by more reliably deaerating even the imperforate bag which can prevent contamination of foreign substances such as insects without any small apertures or any aerating part.

Embodiment 1

Figure 1:
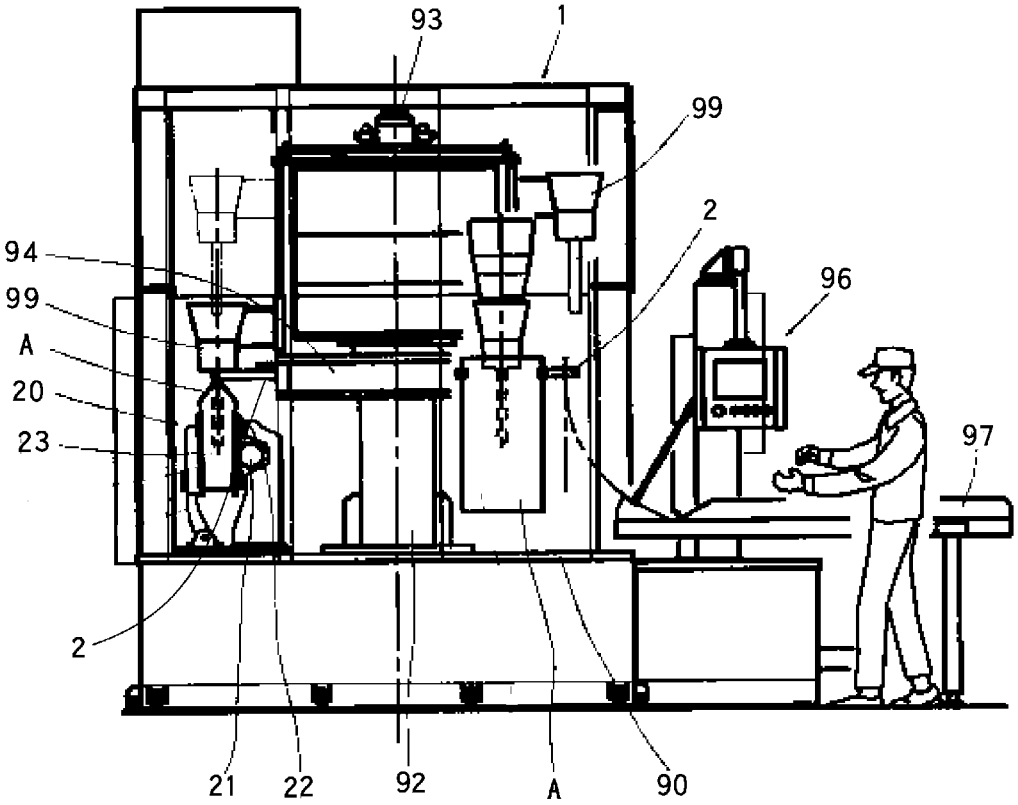
FIG. 1 is a schematic front view of a packaging machine of one embodiment according to the present invention.
Figure 2:
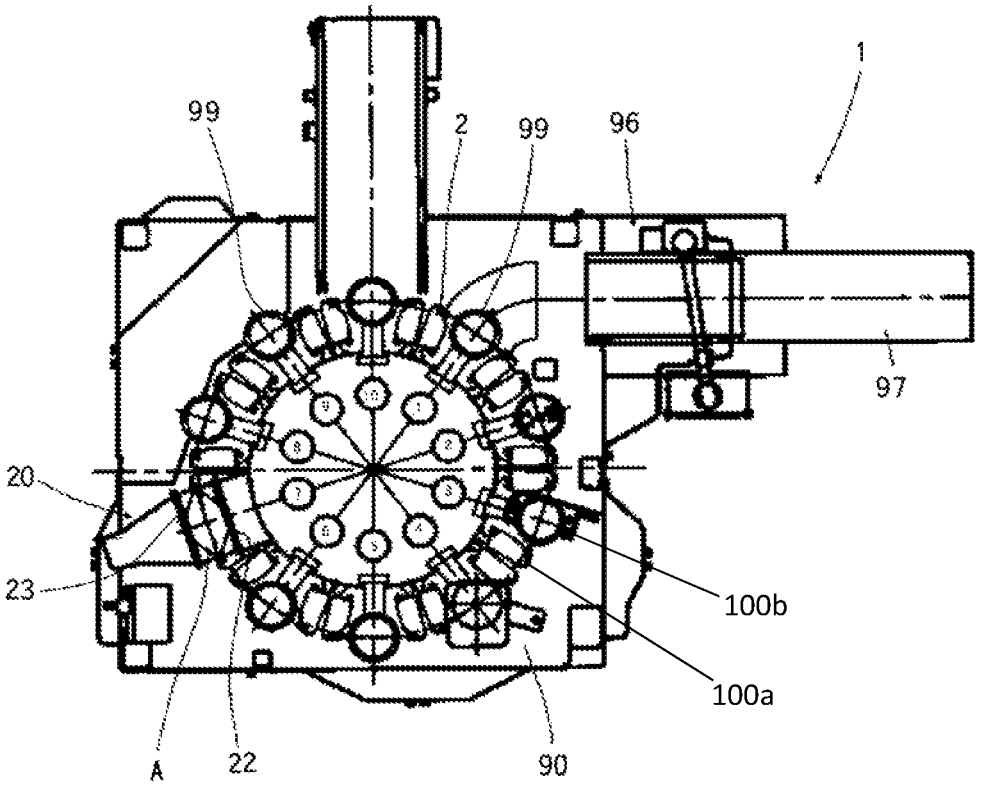
FIG. 2 is a schematic plan view of the packaging machine shown in FIG. 1.

A packaging machine 1 of an embodiment as shown in FIGS. 1 and 2 fills with an article to be packaged a packaging bag A and eliminates air in the bag A by a deaeration nozzle 3 and heat-seals a mouth a. The packaging machine 1 has a closing unit 4 which holds a part of the packaging bag A in a vicinity of the mouth a into which the deaeration nozzle 3 is inserted, from a front and a back of the packaging bag A, thereby closing the packaging bag A. The closing unit 4 includes at least a part which holds the deaeration nozzle 3 and is formed of an elastic member 4*c*. The packaging machine 1 of the embodiment further includes an airway securing unit 10, a shaping press unit 20, a temporary sealing unit 40 and a deaeration unit 50 which can carry out a reliable deaeration in a short time. The aforesaid units will be described in detail later.

The packaging machine 1 of the embodiment is a rotary type gas filled packaging machine as shown in FIG. 1 or 2 and fills the packaging bag with an article such as rice, sugar, salt or pet food and then seals the packaging bag. A packaging method of the packaging machine 1 includes a bag supply process (1), a zippered bag opening process (2), a bag opening process (3), an article fill process (4), a gas charging process (4) to (6), a shaping, deaeration and temporary sealing process (7), a top seal process (8), a seal cooling process (9) and a product ejecting process.

Figure 4:
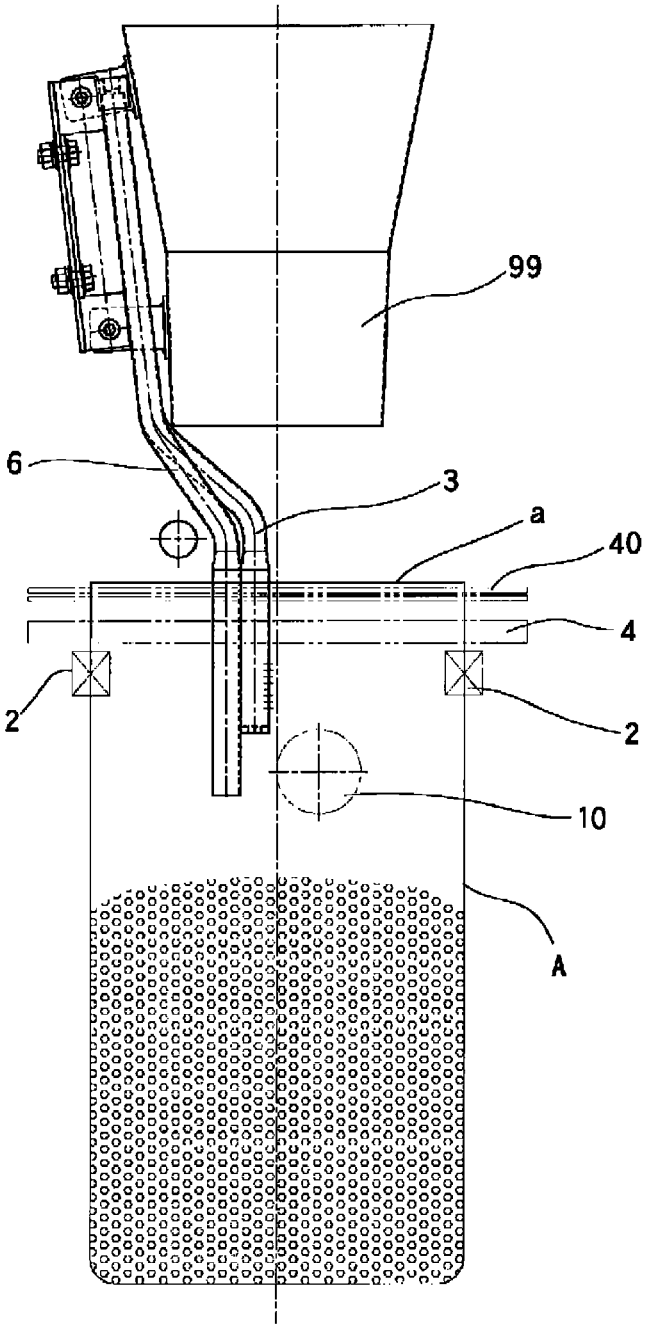
FIG. 4 is a partially enlarged view of the method shown in FIG. 3.

The packaging machine 1 includes a machine base 90 on which is provided a stand 92 rotatably supporting a vertical intermittent rotation shaft 93, as shown in FIG. 1 or 2. A disc-like rotating body 94 is mounted on the intermittent rotation shaft 93. Ten pairs of grips 2 gripping or releasing the packaging bag A are mounted on the rotating body 94 so as to radially protrude at equiangular intervals. The number of grip pairs is equal to the number of steps. The paired grips 2 are configured to grip both sides of the bag A near an upper part of the bag A as shown in FIG. 4 respectively.

A bag placer 96 has a well known structure that packaging bags A laid on a supply stand 97 in a pile are separated one by one from above by a adsorption unit provided with a suction disk (100*a*, 100*b* in FIG. 2) to be supplied to the paired grips 2 in a suspended state with a mouth side up.

Reference numeral 49 designates filling funnels controlled by a drive mechanism (not shown) so that the filling funnels are moved upward and downward. Each funnel 49 includes a deaeration nozzle 3 and a gas charging nozzle 6 as shown in FIG. 4.

Although the packaging machine 1 of the embodiment is of the rotary type, the packaging machine of the invention should not be limited to the rotary type. A linear travel type packaging machine may be employed, instead. The linear travel type packaging machine includes a movable body moved horizontally along an annular passage having, for example, a linear part and semispherical parts on both ends of the linear part. A number of paired grips 2 are mounted on the movable body so as to switchable between a standing posture and a horizontal posture. Packaging bags A supplied at the bag supply step are supported on respective paired grips 2, so that the bags A are intermittently stopped at the opening step, the filling step, the top seal step and the like so as to be filled with the article.

The closing unit 4 is provided for holding a vicinity of the mouth a of the bag A inserted with a deaeration nozzle 3 and a gas charging nozzle 6, from front and back of the bag A on the occasion of deaeration at the shaping, deaeration and temporary sealing step (7), thereby closing the vicinity of the mouth a of the bag A, as shown in FIG. 4. Since the vicinity of the mouth a is closed by the closing unit 4 on the occasion of deaeration, more stable and more reliable deaeration is executable as compared with the case where the mouth a of the bag is open.

Figure 5:
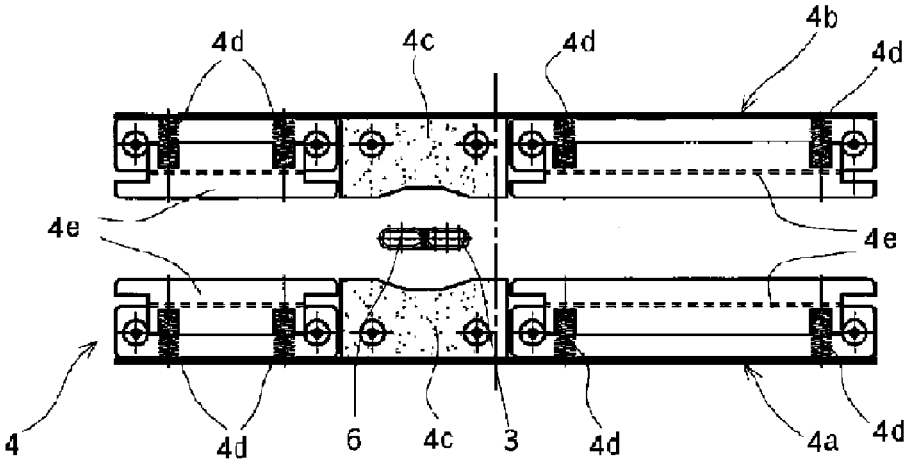
FIG. 5 is a plan view of a closing unit of the packaging machine shown in FIG. 1.

The closing unit 4 has a pair of closing bars 4*a* and 4*b* as shown in FIG. 5. The closing bar 4*a* is adapted to be disposed at the front side of the bag A and the closing bar 4*b* is adapted to be disposed at the back side of the bag A. The closing bars 4*a* and 4*b* are configured to be moved from the front and back of the bag A to the bag A side and to hold the bag A therebetween thereby to close the vicinity of the mouth a of the bag A.

Each one of the paired closing bars 4*a* and 4*b* has a length larger than a width of the bag A in order to close the mouth a of the bag A. Each bar 4*a*, 4*b* includes a portion holding the deaeration nozzle 3 and formed of an elastic member 4*c*.

Figure 6:
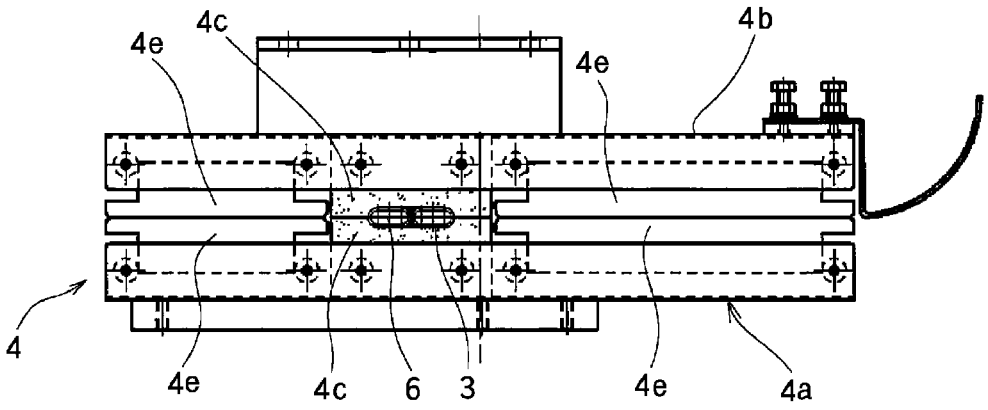
FIG. 6 is a plan view of the closing unit of the packaging machine shown in FIG. 1, explaining the operation of the closing unit.
Figure 7:
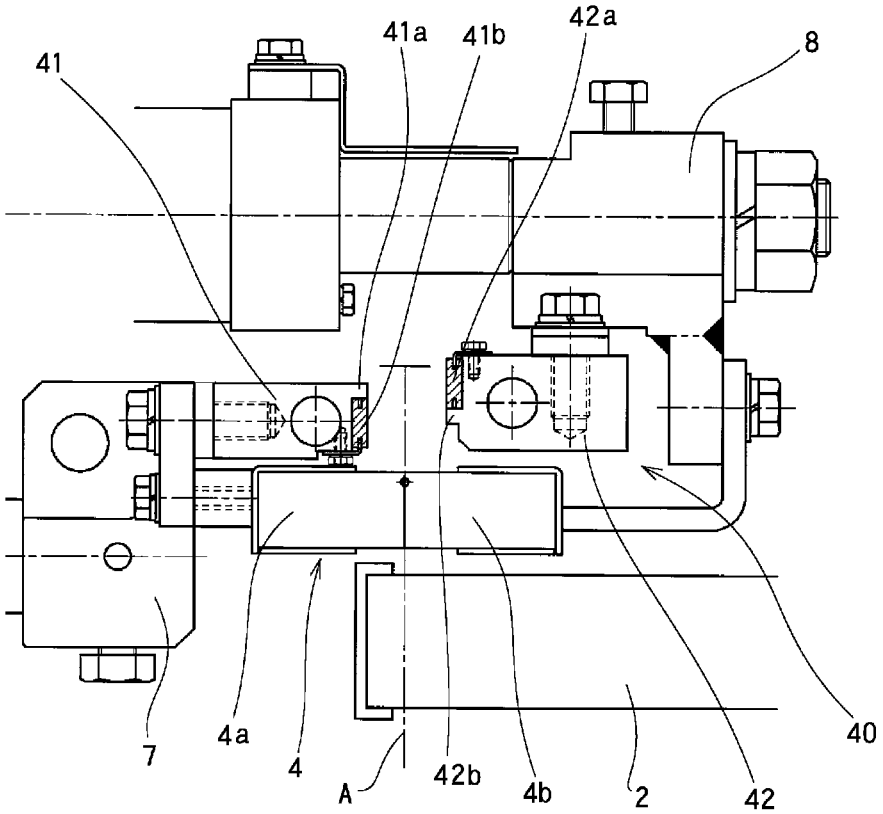
FIG. 7 is an enlarged front view of the closing unit and a temporary sealing unit of the packaging machine shown in FIG. 1.

More specifically, the bars 4*a* and 4*b* in the embodiment include middle portions surrounding the deaeration nozzle 3 and the gas charging nozzle 6 respectively when closing the bag A. The middle portions of the bars 4*a* and 4*b* are formed of sponges 4*c*, which have both lengthwise sides formed of hard bodies 4*e* that are pushed out inward (toward the bag A) by push springs 4*d* respectively. The sponges 4*c* are configured to closely adhere to outer surfaces of the deaeration nozzle 3 and the gas charging nozzle 6 when the bag A is closed, whereby the peripheries of the deaeration nozzle 3 and the gas charging nozzle 6 are also reliably closed, respectively, as shown in FIG. 6.

Although only the portions of the closing bars 4*a* and 4*b* holding the deaeration nozzle 3 and the gas charging nozzle 6 are formed of the elastic members 4*c* in the embodiment respectively, whole closing bars 4*a* and 4*b* may be formed of the elastic members, instead. From a standpoint of durability, however, it is desirable that only the portions holding the nozzles 3 and 6 should be formed of the elastic members 4*c* respectively. Furthermore, each elastic member 4*c* should not be limited to the sponge but may be formed of any material that has a predetermined elasticity and closely adheres to outer surfaces of the nozzles.

Figure 9:
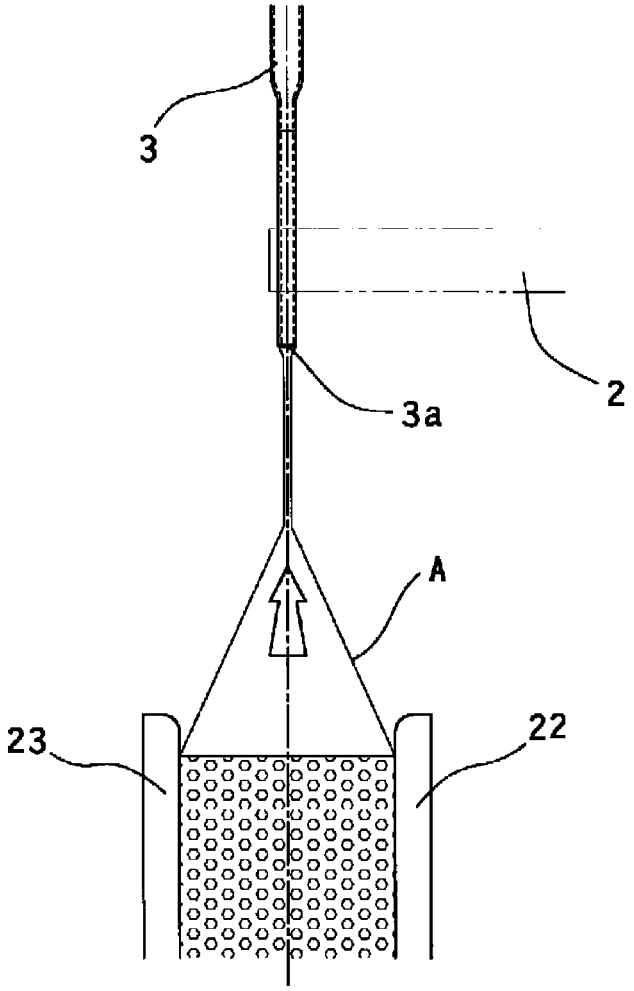
FIG. 9 is an explanatory diagram explaining the operation of the airway securing unit shown in FIG. 8.

The airway securing unit 10 is provided for securing an airway for the deaeration nozzle 3 in the bag A on the occasion of deaeration. More specifically, when an upper surface of the article filling the bag A is excessively away from the distal end 3*a* of the deaeration nozzle 3, the bags (the front and the back) located between the surface of the article and the distal end 3*a* of the nozzle 3 would adhere closely to each other, whereupon it would be difficult or impossible to carry out deaeration, as shown in FIG. 9. The airway securing unit 10 is provided for preventing deaeration from becoming difficult or impossible to carry out.

Figure 8:
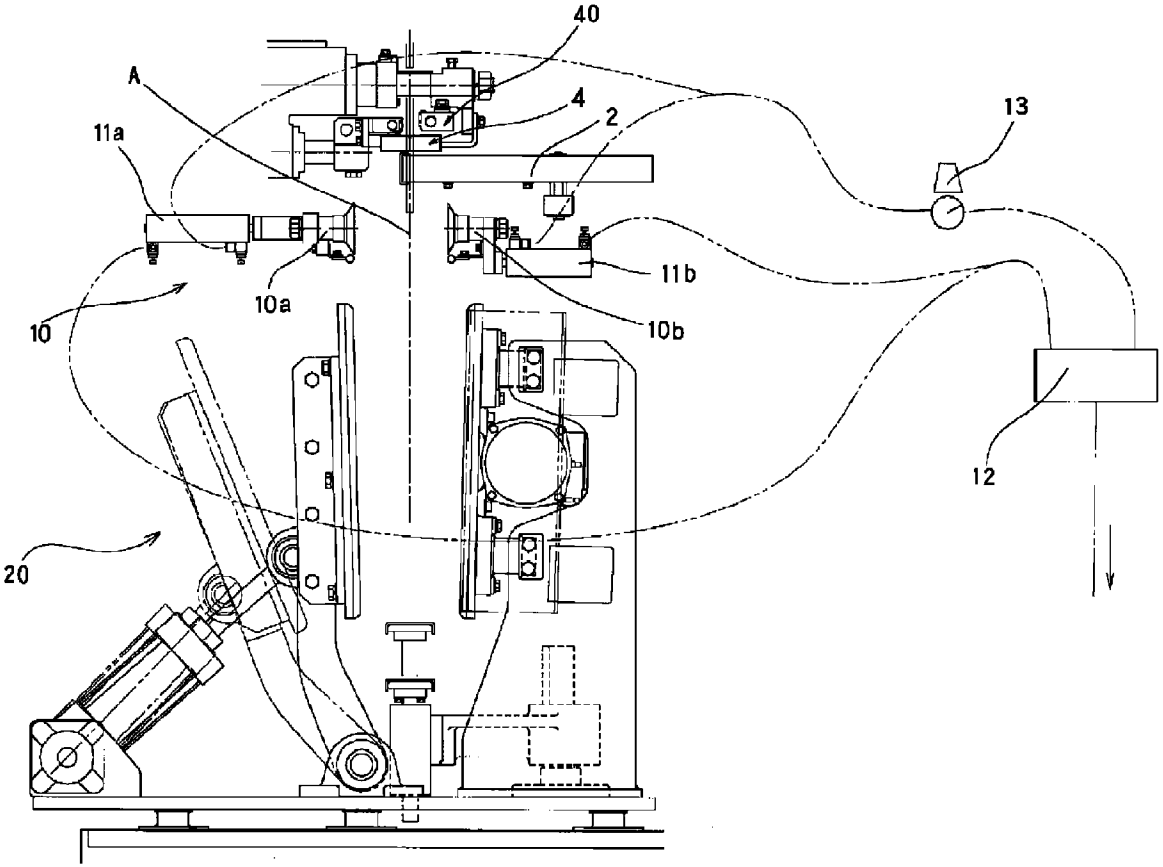
FIG. 8 is an enlarged front view of an airway securing unit of the packaging machine shown in FIG. 1, explaining the airway securing unit.
Figure 10:
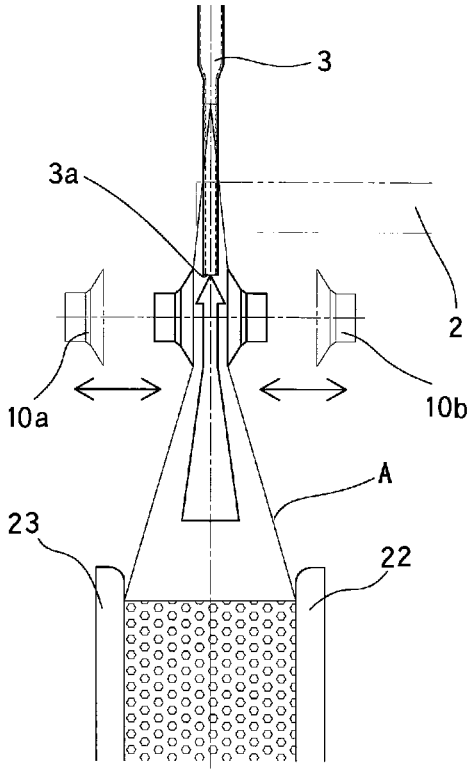
FIG. 10 is also an explanatory diagram explaining the operation of the airway securing unit shown in FIG. 8.
Figure 11:
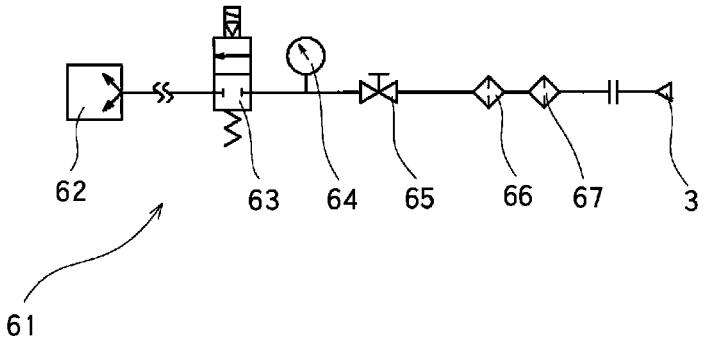
FIG. 11 is an explanatory diagram explaining a conventional deaeration unit.
Figure 11:
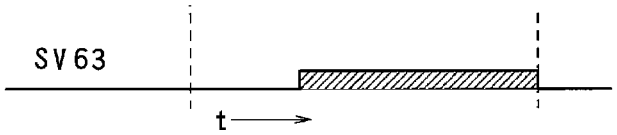

The airway securing unit 10 includes suckers 10*a* and 10*b* provided below the closing unit 4 (paired grips 2) for sucking the bag A from the front and the back of the bag A as shown in FIG. 4 or 10, cylinders 11*a* and 11*b* for horizontally reciprocating the suckers 10*a* and 10*b* so that the suckers 10*a* and 10*b* adhere closely to or depart from the bag A as shown in FIG. 8, a vacuum pump (not shown) for causing the suckers 10*a* and 10*b* to adsorb onto the opposed sides of the bag A and to separate the front and back of the bag A from each other thereby to secure an airway, an electromagnetic valve 12 and a regulator 13 for regulating suction pressure.

The suckers 10*a* and 10*b* adsorbing the front or the front and the back of the bag A are pulled by the cylinders 11*a* and 11*b* in directions such that the suckers 10*a* and 10*b* depart from the bag A, whereby the front and back of the bag A are separated from each other. The airway securing unit 10 is configured so that an airway for deaeration by the deaeration nozzle 3 can be secured by the above-described operation and deaeration can be executed stably.

Figure 13:
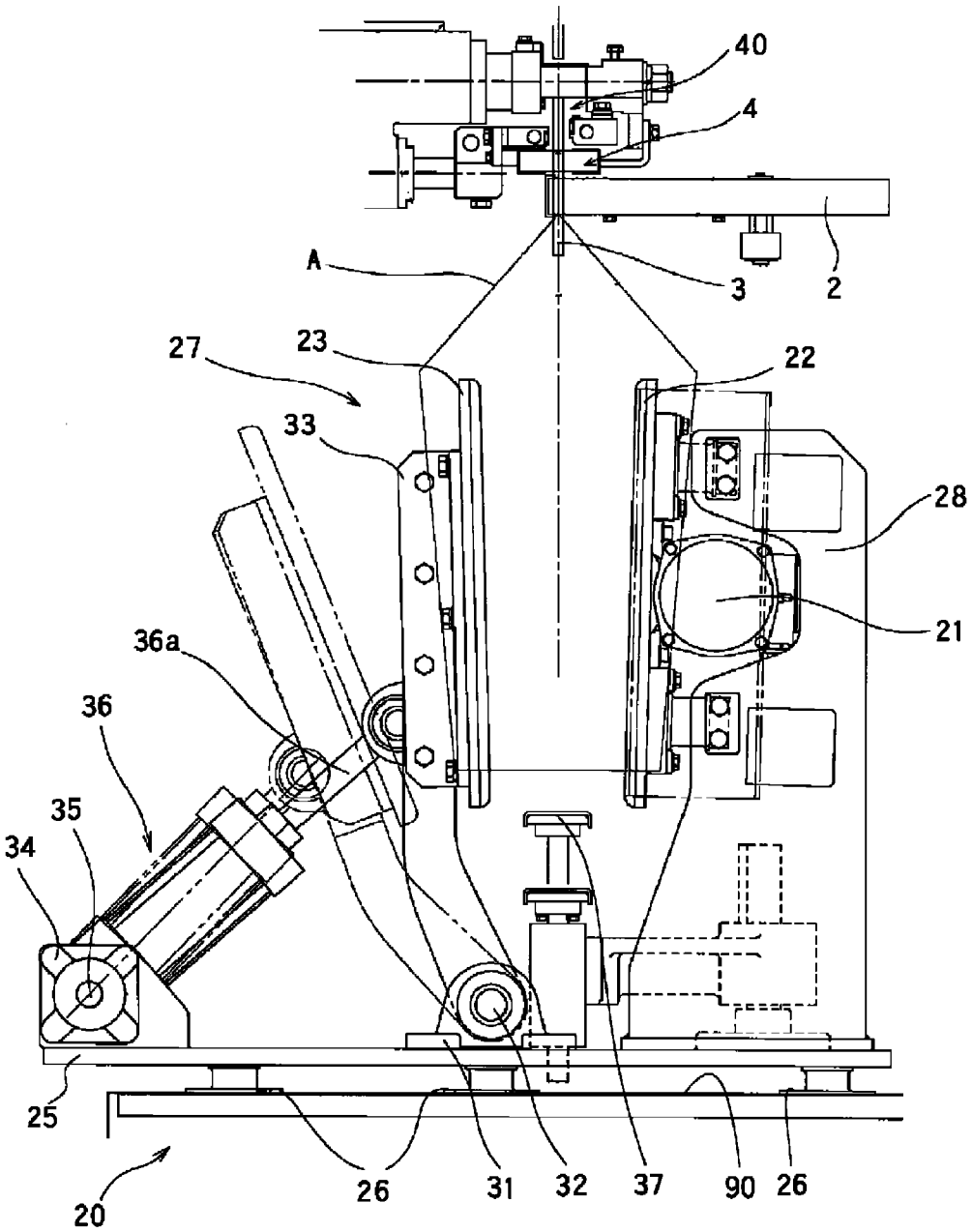
FIG. 13 is an enlarged front view of a shaping press unit of the packaging machine shown in FIG. 1.
Figure 14:
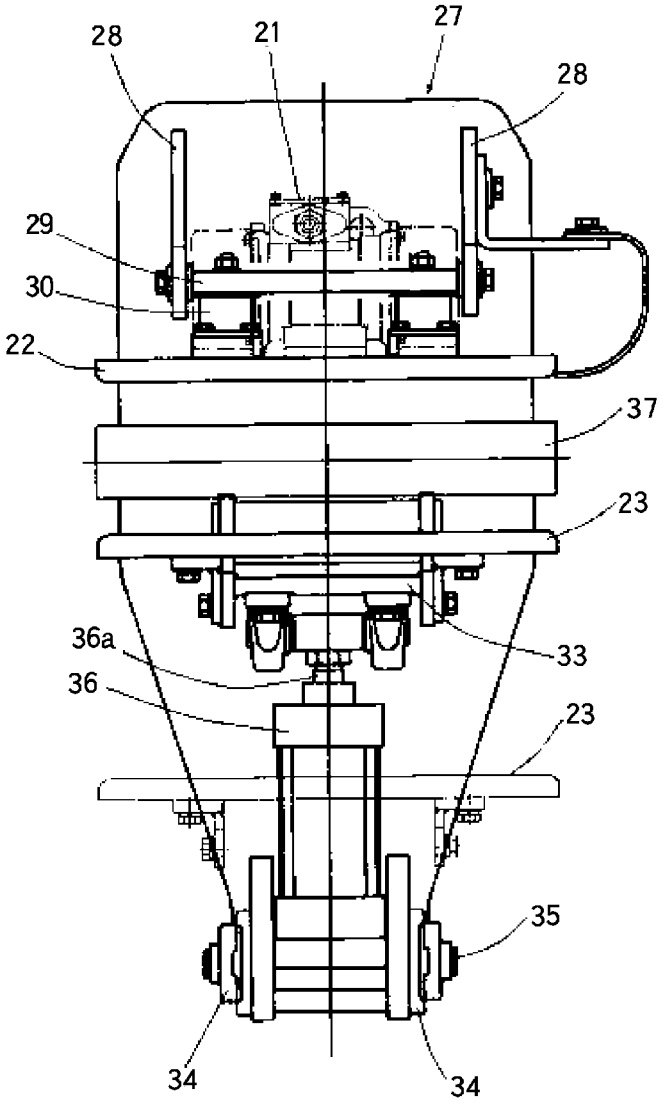
FIG. 14 is an enlarged plan view of the shaping press unit shown in FIG. 13.

The shaping press unit 20 is provided for shaping the bag A filled with an article into such a shape that the bags can be prevented from being damaged or collapsed during storage in a piled state or transportation. The shaping press unit 20 includes a pair of pressing members 22 and 23 to either one of which a vibrator 21 is mounted as shown in FIG. 13 or 14. The pressing members 22 and 23 are allowed to come close to each other and to depart from each other by operation of an actuator (a pneumatic cylinder). Vibration is applied by the vibrator 21 to the bag A filled with the article while the bag A is pressed at the front and rear sides thereof by the pressing members 22 and 23 respectively, so that the article is vertically stretched so as to be shaped into a certain thickness.

Reference numeral 25 designates a base of a pressing unit 27 mounted via a plurality of vibration-proof rubber pieces 26 on the machine base 90. A pair of right and left side plates 28 stand on the base 25 as shown in FIG. 14. A support member 29 extends between the side plates 28. A flat plate-shaped pressing member 22 is fixed via vibration-proof rubber 30 to the front side of the support member 29 so as to be directed vertically. The electrically driven vibrator 21 is fixed to the back side of the pressing member 21.

A rotating shaft 32 is horizontally supported on a pair of bearings 31 fixed to the base 25. A swinging member 33 is rotatably supported on the rotating shaft 32. The pressing member 23 is fixed to the swinging member 33. The pressing members 22 and 23 form a front and rear pair and are disposed so that inner surfaces of both pressing members 22 and 23 face each other.

A rotating shaft 35 is horizontally supported on a pair of bearings 34 fixed to the base 25. The pneumatic cylinder 36 serving as an actuator has a head mounted to the rotating shaft 35. The pneumatic cylinder 36 also has a rod 36*a* with a distal end which is rotatably mounted on a back side of the swinging member 33. A push unit 37 is provided for adjunctively pushing the bottom of the bag A upward in the occasion of the temporary heat sealing.

The bag A filled with the article is placed between the pressing member 22 to which the vibrator 21 is mounted and the pressing member 23 which is allowed to come close to and depart from the pressing member 22 by the actuation of the pneumatic cylinder 36. Vibration by the vibrator 21 is applied to the bag A while the bag A is pressed at the front and rear sides by the pressing members 22 and 23, so that the article is vertically stretched so as to be shaped into a certain thickness. Air in the bag A is eliminated by the deaeration nozzle 3 simultaneously with the shaping by the shaping press unit 20, whereby the article can be maintained in the shaped state with the predetermined thickness by stretching the same vertically and deaeration can be executed more reliably.

The temporary sealing unit 40 is provided for maintaining the deaerated state and disposed over the closing unit 4 as shown in FIG. 4 or 8.

The temporary sealing unit 40 of the embodiment includes a pair of first and second sealing members 41 and 42 which hold the bag A therebetween and sealing the bag A. The first sealing member 41 includes two vertically disposed seal bars 41*a* and 41*b* one (41*a*) of which is comprised of a heating bar and the other (41*b*) of which is comprised of an elastic bar (for example, a rubber bar). The second sealing member 42 includes a seal bar 42*a* disposed opposite the heating bar 41*a* of the first sealing member 41 and a seal bar 42*b* disposed opposite the elastic bar 41*b* of the first sealing member 41. The seal bar 42*a* is comprised of an elastic bar and the seal bar 42*b* is comprised of a heating bar. As the result of the above-described configuration, even when the bag A is a Gusset bag, temporary seal can reliably be applied and the bag can reliably be maintained in the deaerated state.

Figure 15:
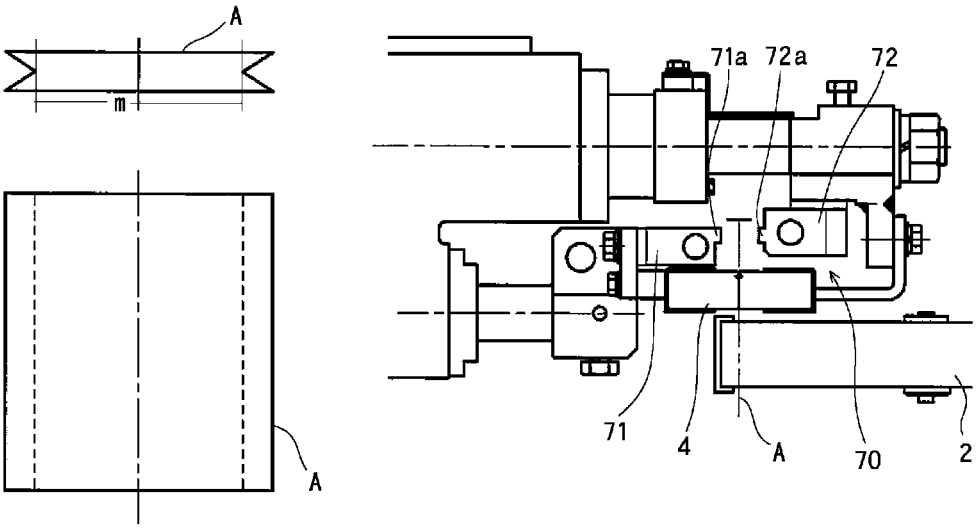
FIG. 15 is an explanatory diagram explaining a temporary sealing unit of another embodiment.

On the other hand, a temporary sealing unit 70 of another embodiment as shown in FIG. 15 includes a first sealing member 71 having a heating bar (an iron bar) 71*a* and a second sealing member 72 having a heating bar (an iron bar) 72*a* disposed opposite the heating bar 71*a* of the first sealing member 71.

When the Gusset bag A with folded portions in both sides as shown in FIG. 15 is held between the heating bars (iron bars) 71*a* and 72*a* and sealed, a part m of the gusset bag A do not adhere due to the thickness of folded portions at both sides and cannot be sealed. Accordingly, when a Gusset bag is sealed, the aforementioned temporary sealing unit 40 is used. However, the temporary sealing unit 70 may be used when a bag has no folded portions.

Figure 16:
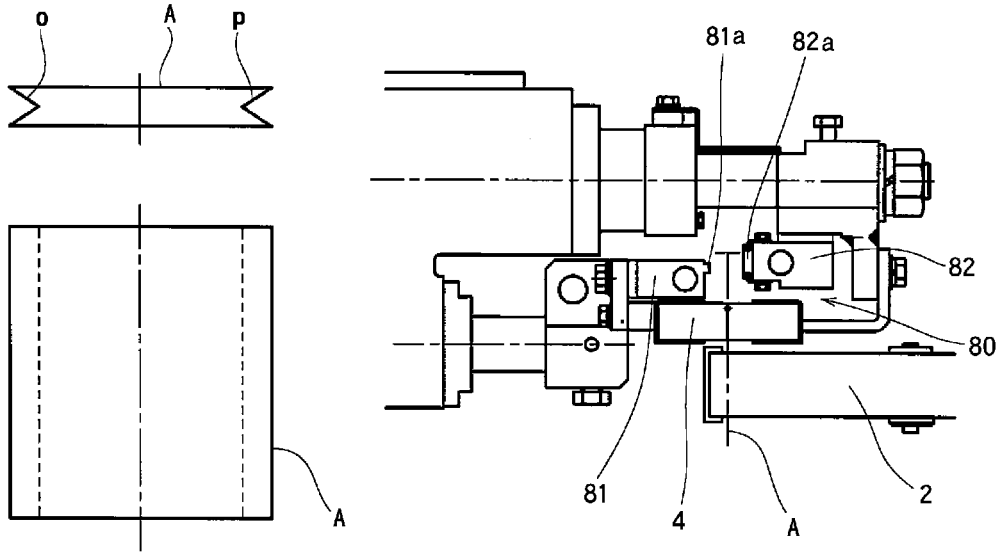
FIG. 16 is an explanatory diagram explaining a conventional temporary sealing unit of another embodiment.

A conventional temporary sealing unit 80 as shown in FIG. 16 includes a first sealing member 81 having a heating bar (an iron bar) 81*a* and a second sealing member 82 having an elastic bar (a rubber bar) 82*a* disposed opposite the heating bar 81*a* of the first sealing member 81.

When a Gusset bag A with folded portions in both sides as shown in FIG. 16 is held between the heating bar (iron bar) 81*a* and the elastic bar (rubber bar) 82*a* and sealed, folded portions O and P at the elastic bar (rubber bar) 82*a* side do not adhere and cannot be sealed. Accordingly, the aforementioned temporary sealing unit 40 is used when a Gusset bag is to be sealed. However, the temporary sealing unit 70 may be used when a bag has no folded portions.

In this regard, the temporary sealing unit 40 includes the first sealing member 41 further including two vertically disposed seal bars 41*a* and 41*b* one (41*a*) of which is comprised of the heating bar and the other (41*b*) of which is comprised of the elastic bar (for example, a rubber bar). The temporary sealing unit 40 also includes the second sealing member 42 further including the seal bar 42*a* disposed opposite the heating bar 41*a* of the first sealing member 41 and comprised of the elastic bar and the seal bar 42*b* disposed opposite the elastic bar 42*b* of the first sealing member 41 and comprised of the heating bar. Accordingly, the part m is reliably held between the heating bar and the elastic bar, and the gusset bag A is sealed at the front and back thereof by the heating bar and the elastic bar. Consequently, no folded portions O and P are provided at the side of the elastic bar (the rubber bar) which is not sealed, and thus, even the Gusset bag A can reliably be sealed.

The first sealing member 41 and the first closing bar 4*a* are fixed to the first movable member 7, which is horizontally reciprocable by a drive unit (not shown) thereby to contact with and depart from the bag A, whereby the first movable member 7 is configured to contact with and depart from the bag A gripped by the paired grips 2.

On the other hand, the second sealing member 42 and the second closing bar 4*b* are fixed to the second movable member 8, which is also horizontally reciprocable by a drive unit (not shown) thereby to contact and depart from the bag A, whereby the second movable member 8 is configured to contact with and depart from the front of the bag A gripped by the paired grips 2.

Figure 12:
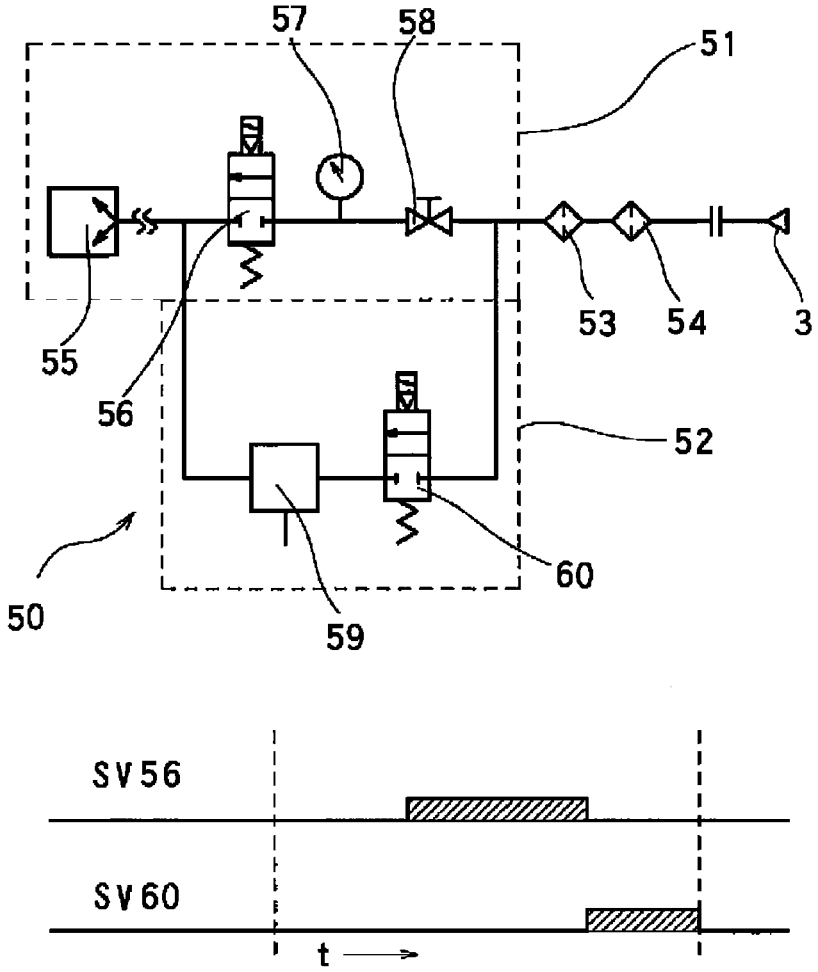
FIG. 12 is an explanatory diagram explaining the deaeration unit of the packaging machine shown in FIG. 1.

Furthermore, a deaeration unit 50 includes a high-pressure vacuum portion 51 and a low-pressure vacuum portion 52 as shown in FIG. 12. The high-pressure or low-pressure portion 51 or 52 is configured to be capable of sucking air remaining in the bag A via filters 53 and 54 by the deaeration nozzle 3.

The high-pressure portion 51 includes a vacuum pump 55, a first electromagnetic valve (SV) 56, pressure instrumentation 67 and a vacuum controller 58. The low-pressure vacuum portion 52 includes an electronic vacuum regulator 59 and a second electromagnetic valve (SV) 60. A rapid deaeration is carried out by the high-pressure vacuum portion at an initial stage of deaeration and thereafter, the high-pressure vacuum is switched to the low-pressure vacuum. Thus, the packaging machine is controlled so that a reliable deaeration can be carried out in a short period of time. Furthermore, a suitable vacuum pressure different from one bag to another is settable on a touch panel (not shown) with the result that the vacuum pressure is adjustable and a deaeration progress can be adjusted and an ideal deaerated state can be provided in the storage of bags piled one upon another.

On the other hand, a conventional deaeration unit 61 includes a vacuum pump 62, an electromagnetic valve (SV) 63, pressure instrumentation 64, a vacuum controller 65, a first filter 66, a second filter 67 and a deaeration nozzle 3. Low-pressure vacuum control is unstable and the deaeration unit 61 lacks reproducibility, with the result that a reliable deaeration cannot be carried out.

Next, a packaging method by the packaging machine 1 of the invention will be described. The packaging method by the packaging machine 1 includes a filling step of filling with an article to be packaged a packaging bag supported in a suspended manner by paired grips 2 with the mouth a thereof on the top, a deaeration step of eliminating air in the packaging bag A by the deaeration nozzle 3 and a sealing step of heat-sealing the mouth a. In the method, the deaeration step is executed in a condition where a vicinity of the mouth a through which the deaeration nozzle 3 is inserted is held from the front and the back of the packaging bag A thereby to be closed, whereby the bag is deaerated.

The packaging method of the invention by the packaging machine 1 has ten processes including a bag supply process (1), a zippered bag opening process (2), a bag opening process (3), an article fill process (4), a gas charging process (4) to (6), a shaping, deaeration and temporary sealing process (7), a top seal process (8), a seal cooling process (9) and a product ejecting process. Since the shaping, deaeration and temporary sealing process (7) is characteristic, this process (7) will be described in detail. Furthermore, the configuration of the packaging machine 1 has been described above and detailed description thereof will be eliminated.

Figure 3:
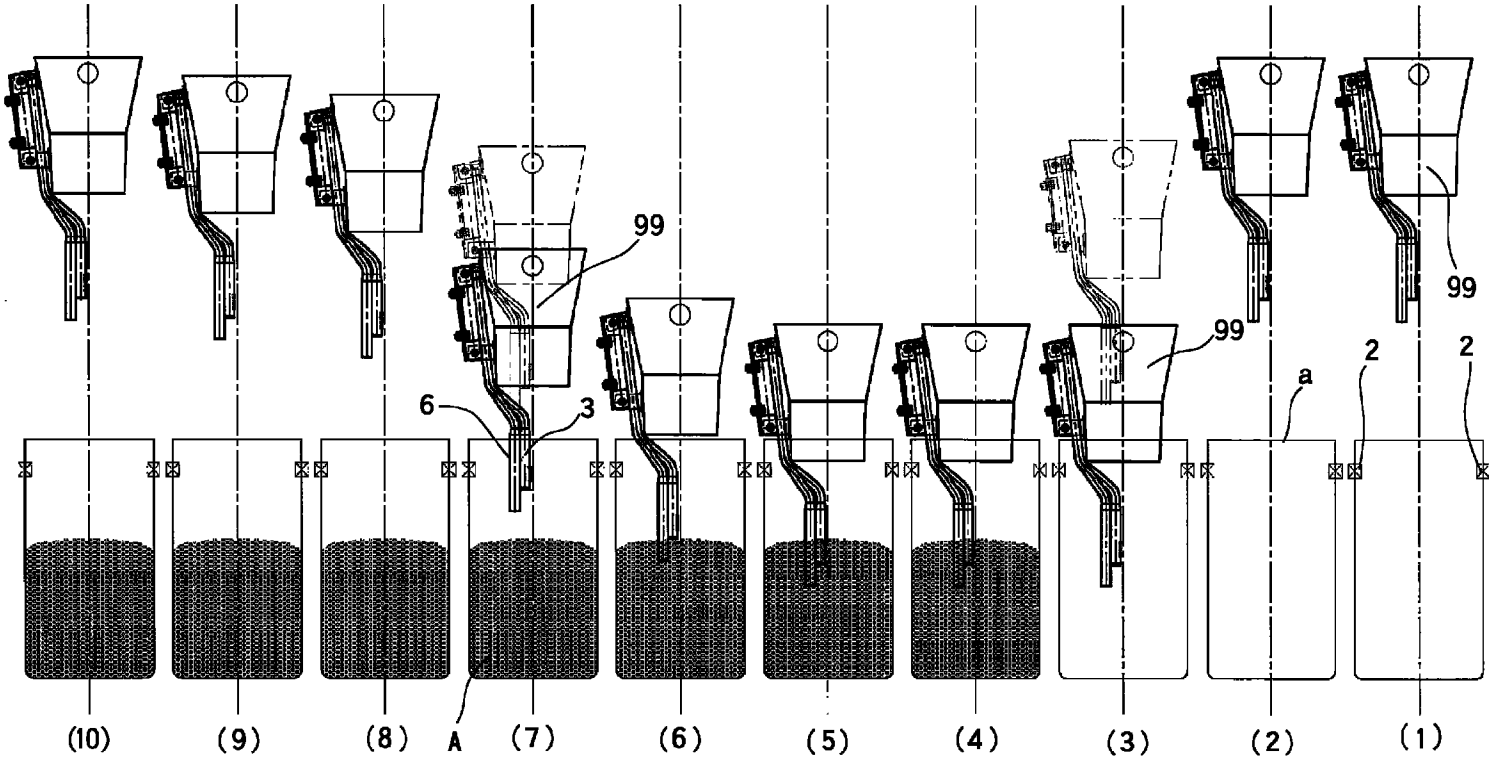
FIG. 3 is an explanatory diagram explaining a packaging method of one embodiment according to the invention.

The packaging bag A is held by the paired grips 2 in the bag supply process (1) as shown in FIG. 3. In the zippered bag opening process (2) and the bag opening process (3), the bag A is suctioned from the front and the back thereof by a suction unit and the mouth a is closed, and thereafter, the filling funnels 49 are moved downward and distal ends of the deaeration nozzle 3 and the gas displacement nozzle 6 are inserted into the bag A. In the article fill process (4), the bag A supported by the paired grips 2 is filled with a predetermined amount of article. In the gas charging process (4) to (6), the bag A is filled with a gas for preservation of the article.

In the shaping, deaeration and temporary sealing process (7) which is a characteristic process of the invention, the deaeration nozzle 3 is moved upward in the bag A so as to be located over the upper surface of the article.

Subsequently, the vicinity of the mouth a in the bag A inserted with the deaeration nozzle 3 and the gas fill nozzle 6 is held from the front and the back thereof by the closing unit 4 thereby to be closed. More specifically, the first closing bar 4*a* is brought into contact with the bag A by horizontally moving the first moving body 7 from the front side of the bag A, and the second closing bar 4*b* is brought into contact with the bag A by horizontally moving the second moving body 8 from the back side of the bag A, whereby the bag A is held between the first and second closing bars 4*a* and 4*b* from the front and the back thereof thereby to be closed.

In this case, since the middle portions of the closing bars 4*a* and 4*b* constituting the peripheries of the deaeration nozzle 3 and the gas charging nozzle 6 are formed of the elastic members (sponges) 4*c*, respectively, the sponges 4*c* closely adhere to outer surfaces of the deaeration nozzle 3 and the gas charging nozzle 6 with the result that the peripheries of the aeration nozzle 3 and the gas charging nozzle 6 are reliably be closed. Consequently, since the vicinity of the mouth a is closed, more stable and more reliable deaeration is executable as compared with the case where the mouth a of the bag is open.

Furthermore, the surface and back sides of the bag A are pulled by the cylinders 11*a* and 11*b* in such directions that the suckers 10*a* and 10*b* depart from the bag A, while the suckers 10*a* and 10*b* adsorb the front and back sides of the bag A. Consequently, the surface and back sides of the bag A are separated from each other with the result that an airway for deaeration by the deaeration nozzle 3 can reliably be secured.

Deaeration and shaping are simultaneously carried out in the above-described state. More specifically, the bag A filled with the article is placed between pressing members 22 and 23. Vibration is applied to the bag A by the vibrator 21 while the bag A is pressed from the surface and back sides thereof by the pressing members 22 and 23, whereby the article is vertically stretched to be shaped into the predetermined thickness.

Air in the bag A is eliminated by the deaeration nozzle 3 simultaneously with the shaping by the shaping press unit 20, whereby the article can be maintained in the shaped state with the predetermined thickness by stretching the same vertically and deaeration can be executed more reliably. Furthermore, a rapid deaeration is carried out by the high-pressure vacuum portion at an initial stage of deaeration and thereafter, the high-pressure vacuum is switched to the low-pressure vacuum. Consequently, an accurate deaeration is carried out in a short period of time.

Upon end of deaeration and shaping, the deaeration nozzle 3 and the gas charging nozzle 6 are moved upward thereby to depart from the mouth a of the bag A and the mouth a is immediately sealed by the temporary sealing unit 40. More specifically, the first sealing body 41 is brought into contact with the bag A by horizontally moving the first moving body 7 from the front side of the bag A, and the second sealing body 41 is brought into contact with the bag A by horizontally moving the second moving body 8 from the back side of the bag A, whereby the temporary sealing is carried out.

Even when the bag A to be temporarily sealed is a Gusset bag, one (41*a*) of the two vertically disposed seal bars 41*a* and 41*b* of the first sealing body 41 is comprised of the heating bar and the other (41*b*) is comprised of the elastic bar (rubber bar, for example). The seal bar 42*a* of the second sealing body 42 disposed opposite the heating bar 41*a* of the first seal body 41 is comprised of the elastic bar and the seal bar 42*b* of the second sealing body 42 is comprised of the heating bar. Consequently, the bag A is reliably sealed.

According to the above-described packaging machine 1 and the packaging method of the invention, the vicinity of the mouth a of the packaging bag A is reliably closed by the closing unit 4. The airway for deaeration is reliably secured by the airway securing unit 10. Shaping is carried out by the shaping press unit 20 with deaeration being executed. High-pressure vacuum is employed at the initial stage of deaeration and thereafter, the high-pressure vacuum is switched to low-pressure vacuum, whereupon accurate deaeration is carried out in a short period of time. The temporary sealing unit 40 is provided which reliably seals even the Gusset bag. Consequently, reliable and accurate deaeration can be carried out in a short period of time, and packaging can be carried out which can reliably prevent the packaging bags from being damaged or collapsed during storage in a piled state or transportation even when the bag is an imperforate bag.

Subsequently, the top seal is applied to the bag in the top seal process (7) and the part to which the top seal has been applied is cooled in the cooling process (8). Furthermore, the bag A is ejected onto the conveyor in the product ejection process (9), whereby packaging by the packaging machine 1 of the invention is completed.

The temporary sealing unit 40 is dedicated to temporary sealing in the above-described packaging machine 1 or packaging method. In the top seal process executed after the temporary sealing, the top seal is applied to the bag using another top seal unit. However, the packaging machine and the packaging method of the invention include the configuration and use of the temporary sealing unit 40 as the top sealing unit. Furthermore, although the temporary sealing unit 40 is used to temporarily seal the Gusset bag in the above-described packaging machine and the packaging method, the packaging machine and the packaging method of the invention include use of the temporary sealing unit 40 in temporary sealing or top sealing of bags other than the Gusset bag.

| Explanation of Reference Symbols | |
|---|---|
| 1 packaging machine | 2 paired grips |
| 3 deaeration nozzle | 4 closing unit |
| 6 gas charging nozzle | 7 first moving body |

-continued

| Explanation of Reference Symbols | |
|---|---|
| 8 second moving body | 10 airway securing unit |
| 20 shaping press unit | 40 temporary sealing unit |
| 50 deaeration unit | |

The invention claimed is:

1. A packaging machine which fills with an article to be packaged, a packaging bag supported in a suspended manner by a pair of grips with a mouth thereof on the top, removes air in the packaging bag by a sucking, deaeration nozzle and heat-seals the mouth, the machine comprising:

a gas charging nozzle configured to supply gas to the packaging bag;

a suction unit configured to open the packaging bag;

a closing unit which holds a part of the packaging bag in a vicinity of the mouth through which the sucking deaeration nozzle is inserted, from a front and a back of the packaging bag, thereby closing the packaging bag; and an airway securing unit having a pair of suckers which is provided at the front and the back of the packaging bag near an end of the sucking deaeration nozzle, configured to secure an airway for the sucking deaeration nozzle when gas is eliminated from the bag.

2. The packaging machine according to claim 1, wherein the closing unit includes at least a part which holds the sucking deaeration nozzle, the part being formed of an elastic member.

3. The packaging machine according to claim 1, further comprising a shaping press unit which includes a pair of pressing members to either one of which a vibrator is mounted, the pressing members being capable of coming close to each other and departing from each other by operation of an actuator, wherein the shaping press unit applies vibration by the vibrator to the packaging bag while pressing the packaging bag from front and rear sides by the pressing members respectively, thereby stretching the article in an up-down direction thereby to shape the packaging bag into a predetermined thickness.

4. The packaging machine according to claim 3, wherein air in the sucking deaeration nozzle is removed from the packaging bag simultaneously with shaping by the shaping press unit.

5. The packaging machine according to claim 1, further comprising a temporary sealing unit which maintains a deaerated state, wherein the temporary sealing unit is provided with a pair of a first seal body and a second seal body which hold the packaging bag therebetween and seal the packaging bag;

the first seal body includes two seal bars which are disposed up and down, one of the seal bars being comprised of a heating bar and the other being comprised of an elastic bar; and the second seal body includes two seal bars which are comprised of an elastic bar disposed opposite the heating bar of the first seal body and a heating bar disposed opposite the elastic bar of the first seal body.

6. Providing the packaging machine of claim 1, a packaging method comprising:

a filling step of filling with the article to be packaged the packaging bag supported in the suspended manner by the pair of grips with the mouth thereof on the top;

a gas charging step of supplying gas to the packaging bag using a gas charging nozzle;

a deaeration step of removing air in the packaging hag by the sucking deaeration; and a sealing step of heat-sealing the mouth, wherein the deaeration step is executed in a condition where a part of the packaging bag in the vicinity of the mouth into which the sucking deaeration nozzle is inserted is held by the closing unit from the front and back of the packaging bag thereby to be closed;

wherein during the deaeration step an airway is secured by the airway securing unit having a pair of suckers which is provided at the front and the back of the packaging bag near an end of the sucking deaeration nozzle, configured to suction the packaging bag from the opposite sides of the packaging bag, during elimination of gas from the bag.

7. The method according to claim 6, wherein the closing unit includes at least a part which holds the sucking deaeration nozzle, the part being formed of an elastic member.

8. The method according to claim 6, wherein removal of air in the deaeration step is controlled so that a high pressure suction is carried out at start of removal and thereafter, the high pressure suction is switched to a low pressure suction.

9. The method according to claim 6, wherein in the deaeration step, a vibrator applies vibration to the packaging bag while the packaging bag filled with the article is being pressed from front and rear sides thereof by a shaping press unit which includes a pair of pressing members to either one of which the vibrator is mounted, respectively, whereby the packaging bag is deaerated while the article is stretched in an up-down direction thereby to be shaped into a predetermined thickness, the shaping press unit including a pair of pressing members to at least either one of which the vibrator is mounted, the pressing members being capable of coming close to each other and departing from each other by operation of an actuator.

10. The method according to claim 6, wherein in the deaeration step, after the sucking deaeration nozzle has been removed from the packaging bag, the mouth of the packaging bag is temporarily sealed by a temporary sealing unit so that the packaging bag is maintained in a deaerated state.

11. The method according to claim 10, wherein the temporary sealing unit is provided with a pair of a first seal body and a second seal body which hold the packaging bag therebetween and seal the packaging bag;

the first seal body includes two seal bars which are disposed up and down, one of the seal bars being comprised of a heating bar and the other being comprised of an elastic bar; and the second seal body includes two seal bars which are comprised of an elastic bar disposed opposite the heating bar of the first seal body and a heating bard disposed opposite the elastic bar of the first seal body.

* * * * *